US006524396B1

(12) United States Patent
Geke et al.

(10) Patent No.: US 6,524,396 B1
(45) Date of Patent: Feb. 25, 2003

(54) AGENT AND METHOD FOR MACHINING METAL AND FOR CLEANING METAL OR ANTICORROSION TREATMENT

(75) Inventors: Juergen Geke, Duesseldorf (DE); Hans-Peter Oelscher, Haan (DE); Anders Johansson, Alingsas (SE)

(73) Assignee: Henkel Kommanditgesellschaft aut Aktien, Gulph Mills, PA (US)

( * ) Notice: Subject to any disclaimer, the term of this patent is extended or adjusted under 35 U.S.C. 154(b) by 0 days.

(21) Appl. No.: 09/762,346

(22) PCT Filed: Jul. 27, 1999

(86) PCT No.: PCT/EP99/05373

§ 371 (c)(1),
(2), (4) Date: Apr. 11, 2001

(87) PCT Pub. No.: WO00/08236

PCT Pub. Date: Feb. 17, 2000

(30) Foreign Application Priority Data

Aug. 5, 1998 (DE) ..... 198 35 328

(51) Int. Cl.[7] ..... B08B 3/08; C11D 1/72; C11D 1/722; C23G 5/032

(52) U.S. Cl. ..... 134/28; 134/26; 508/530; 508/532; 510/264; 510/266; 516/72; 516/76

(58) Field of Search ..... 516/72, 76; 134/26, 134/28; 510/264, 266, 422; 508/530, 532

(56) References Cited

U.S. PATENT DOCUMENTS

| | | | | |
|---|---|---|---|---|
| 2,516,838 A | | 8/1950 | Schiermeier | |
| 3,769,214 A | * | 10/1973 | Davis | 508/530 X |
| 3,997,359 A | * | 12/1976 | Dankoff et al. | 134/26 X |
| 4,759,861 A | * | 7/1988 | Ogura et al. | 508/530 X |
| 4,830,768 A | * | 5/1989 | Reich et al. | |
| 5,230,730 A | * | 7/1993 | Speckmann et al. | 516/76 X |
| 5,286,300 A | | 2/1994 | Hnatin et al. | 134/2 |
| 5,658,869 A | * | 8/1997 | Singer | 510/422 X |
| 5,932,023 A | * | 8/1999 | Ward et al. | 134/28 X |
| 6,057,284 A | | 5/2000 | Baur et al. | 510/506 |
| 6,420,323 B2 | * | 7/2002 | Geke et al. | 508/532 |

FOREIGN PATENT DOCUMENTS

| | | |
|---|---|---|
| DE | 43 23 909 | 1/1995 |
| DE | 196 21 843 | 12/1997 |
| DE | 197 03 083 | 7/1998 |
| EP | 0 376 367 | 7/1990 |
| EP | 0 652 281 | 5/1995 |

* cited by examiner

*Primary Examiner*—Richard D. Lovering
(74) *Attorney, Agent, or Firm*—Stephen D. Harper; Daniel S. Ortiz

(57) ABSTRACT

A process for metal cutting using a water-mixed cutting compound and subsequent cleansing and corrosion protective treatment wherein an oil in water emulsion is used as a cutting compound which contains;

(I) an amount emulsifier system consisting of:

(a) ethyoxylates/propoxylates of fatty alcohols having 8 to 18 carbon atoms in the alcohol, which contains 2 to 6 ethylene oxide units and 4 to 8 propylene oxide units;

(b) fatty alcohols and/or fatty alcohols propoxylates having 12 to 24 carbon atoms in the alcohol and 0 to 3 propylene oxide units and/or distillation residues of such fatty alcohols;

In a ratio by weight, a:b=1:0.2 to 0.2:1;

and (ii) corrosion inhibitory; and an aqueous solution or suspension is used for cleansing an anti-corrosion treatment which contains the same emulsifier system and the corrosion inhibitors as the cutting compound. The cutting compound and the cleansing and corrosion protective treatment material comprise a systems for treating the metal during cutting and cleansing.

13 Claims, No Drawings

AGENT AND METHOD FOR MACHINING METAL AND FOR CLEANING METAL OR ANTICORROSION TREATMENT

This application is a 371 of PCT/EP99/05373 filed Jul. 27, 1999.

FIELD OF THE INVENTION

This invention relates to metal machining and involves mechanical cutting of metal, followed by cleansing and/or anticorrosion treatment. A 'metal cutting' procedure is to be understood to be a process in which the shape of a metal item is altered by removing material from the piece being machined with a machining tool. Examples of such a metal cutting procedure are drilling turning, milling and grinding. During these processes, the tool and the piece being machined have to be washed with a liquid cooling lubricant (cutting compound). This serves to lubricate the tool in order to avoid welding and overheating, to dissipate the heat being produced and to remove the turnings or other metal particles which are produced. The cutting compound has to be formulated in such a way that it prevents corrosion of the piece being machined.

BACKGROUND OF THE INVENTION

Cutting compounds which are known for use in engineering include oils, oil-in-water emulsions or water-dissolved, cutting compounds which consist only of an aqueous solution. In the present invention, oil-in-water emulsions and water-miscible concentrates thereof, that is cutting compounds which contain an oil component are considered.

In the processing sequence for a metallic item, the item is generally cleansed and/or protected against corrosion after a cutting procedure. Cleansing should remove in particular residues of the cutting compound, but also other soiling and any metal particles which are still adhering to the item. Hitherto, the choice of cleanser has only been affected by the nature of the cutting compound used during metal machining prior to the cleansing step insofar: as the cleanser has to remove the lubricant. All the constituents of the cutting compound represent 'contaminants' for the cleanser, which render the cleanser unusable: after a period of time. Depending on the degree of contamination with cutting compound, the cleanser either has to be topped-up with fresh cleansing-active components, file liquid bath has to be regenerated or the batch discarded and a new batch prepared. This leads to a high consumption of cleanser-active substances which have to be disposed of at the end of their useful life. This involves environmental pollution and Is also economically disadvantageous due to the amount of material consumed.

BRIEF DESCRIPTION OF THE INVENTION

The present invention provides a combination of an agent and a process for metal cutting procedures which makes use of a water-mixed cutting compound, followed by cleansing and/or corrosion protection of the metal part being processed with an aqueous cleansing/anticorrosion agent in which the constituents of the cutting compound and the aqueous cleansing/anticorrosion agent are mutually adjusted in such a way that the constituents of the cutting compound augment, or at least do not impair, the cleansing/anticorrosion agent. With this system, the cutting compound is not a 'contaminant' in the cleansing/anticorrosion agent, rather it adds to the effectiveness of the latter. This means that smaller amounts of active substances have to be used for the cleansing/anticorrosion agent itself. The service time of the cleansing/anticorrosion agent is also extended without having to recondition the bath. The use of smaller amounts of substances and lower waste Disposal costs protect the environment and make the entire process cheaper.

A first embodiment of the present invention relates to a combination of agents consisting of a first agent for metal cutting procedures and a second agent for subsequent cleansing and/or anticorrosion treatment, characterised in that the first and second agent contain:

(i) an emulsifier system consisting of:

(a) ethoxylates/propoxylates of fatty alcohols having 8 to 18 carbon atoms in the alcohol, which contains 2 to 6 ethylene oxide units and 4,to 8 propylene oxide units;

and (b) fatty alcohols and/or fatty alcohol propoxylates having 12 to 24 carbon atoms in the alcohol and 0 to 3 propylene oxide units and/or distillation residues of such fatty alcohols;

in a ratio, by weight, a:b=1:0.2 to 0.2:1;

and (ii) corrosion inhibitors;

wherein the first agent also contains an oil component.

The emulsifier system used according to the present invention is known from German Patent Application DE-A-197 03 083. Compared with conventional emulsifier systems, it has the advantage that it tends to form only very little foam in soft to moderately hard water, that is in water having, less than 12°, and in particular less than 8°, dH.

DETAILED DESCRIPTION OF THE INVENTION

Strict requirements are thus solaced on the composition of the emulsifier system and the molecular structure of the emulsifiers used. In the first instance, according to (a), fatty alcohol ethoxylates/propoxylates have to be present which contain 2 to 6 ethylene oxide units and also 4 to 8 propylene oxide units. These hydrophilic components have to be combined with the hydrophobic components (b), non-alkoxylated fatty alcohols having 12 to 24 carbon atoms, distillation residues thereof or alkoxylation products thereof having up to, on average, at most 3 propylene oxide units. Furthermore, the approximate ratio, by weight, which is given above must be observed. Distillation residues of fatty alcohols having 12 to 24 carbon atoms are obtainable from Henkel KGaA, Düsseldorf, under the name Pernil® RU.

Non-polar or polar oils of petrochemical or natural origin may be used as the oil component in the first agent. Synthetic oil components are also suitable. Examples of oil components which may be us,ed are paraffinic or naphthenic mineral oil, dialkylethers having 12 to 20 carbon atom.,t and ester oils. The ester oils may be of plant or animal origin and are available as esters of glycerine with three fatty acids (so-called fatty acid triglycerides). One example of this type of ester oil is rape seed oil. Such ester oils may also be obtained synthetically by esterifying glycerine using selected fatty acids or by transesterifying naturally occurring fats and oils using other fatty acids.

The corrosion inhibitors which are used according to the present invention in the aqueous cutting compound and also in the aqueous cleansing/anticorrosion agent and in each of the concentrates thereof are preferably selected from alkanolamines and/or from branched or unbranched, saturated or unsaturated aliphatic mono- or di-carboxylic acids having 6 to 10 carbon atom and/or from aromatic carboxylic acids having 7 to 10 carbon atoms, wherein the carboxylic acids are present partially or completely as salts. When alkanolamines and salts of carboxylic acids are mentioned, this may mean, on the one hand, that the alkanolamine salts of the carboxylic acids are used directly. This is equivalent to a mixture of alkanolamines and carboxylic acids which react with each other to form salts. On the other hand, the alkanolamines may be used as such and the carboxylic acids may be us d as alkali metal salts, preferably as potassium salts. Mixtures of carboxylic acids; and alkali metal hydroxides are equivalent to the alkali metal salts of carboxylic acids. Depending on the pH of the ready-to-use water-mixed cutting compound or the aqueous cleansing/anticorrosion agent, the alkanolamines and/or carboxylic acids are present as equilibrium mixtures consisting of neutral molecules and cations in the case of alkanolamines or anions in the case of carboxylic acids.

The first agent (the cutting compound or its concentrate) and the second agent (the cleansing/anticorrosion agent or its concentrate) may contain the same corrosion inhibitors. However, this is not necessary. It simply has to be ensured that the first agent and also the second agent each contain one or more of the previously-mentioned corrosion inhibitors. However, it is preferable if the first agent contains one or more corrosion inhibitors which are, also present in the second agent. If both agents in ready-to-use form are present during continuous operation, the combination of corrosion inhibitors, which is present in the first agent, is automatically also produced over the course of time in the cleansing/anticorrosion agent as a result of the continuous transfer of cutting compound residues into the cleansing/anticorrosion agent.

When used for metal cutting, procedures, the first agent, the water-mixed cutting compound, may in principle be mixed on site, in such a way that the individual components are dissolved or emulsified in water at the required concentrations. Conventional engineering practice, however, is to purchase water-miscible cutting compounds in the form of a concentrate which contains the individual active substances in the correct weight ratio, but in concentrated form. When used, this concentrate has to be diluted with water to the application concentration on site.

The aqueous cleansing/anticorrosion agent may in principle also be prepared in such a way that the individual active substances are dissolved or suspended in water at the concentrations required on site. As in the case of the cutting compound, however, the same procedure as describe above may also preferably be used by purchasing concentrates of cleansing/anticorrosion agents and diluting with the required amount of water on site.

Accordingly, the first agent and also the second agent may be present as a water-miscible concentrate in the combination of agents according to the present invention. Preferably, the first agent contains 10 to 40 wt. % of the oil component, 10 to 40 wt. % of the emulsifier system and 20 to 40 wt. % of corrosion inhibitors. The second agent preferably contains 10 to 40 wt. % of emulsifier system and 20 to 40 wt. % of corrosion inhibitors. Both agents may optionally contain additional water and/or other active substances and auxiliary agents, wherein the ratios, by weight, are obviously selected in such a way that the sum of the components is 100 wt. %.

For example, the first agent may contain as further active substances and auxiliary agents: lubricant additives in, general and in particular so-called 'extreme pressure' additives (EP additives), further corrosion inhibitors, such as boric acid or alkylphosphonic acids and additional alkanolamines and solvent promoters, such as glycols, glycerine or sodium cumene sulfonate. For use in processing non-ferrous heavy metals, specialised non-ferrous heavy metal corrosion inhibitors may also be used. Examples of these are benzotriazole, tolyltriazole, thiazoles or salts of pyridinethiol-N-oxide. Biocides which extend the lifetime of the ready-to-use cutting compound emulsion prepared from the concentrate by mixing with water may also be added. If required, however, these biocides may be added directly to the ready-to-use water-mixed cutting compound emulsion.

The first agent may consist exclusively of the oil component, the emulsifier system and the corrosion inhibitors. Depending on the method of preparation, however, it may also contain small amounts of water, for example in the range from about 2 to about 10 wt. %. This gets into the agent via the raw materials which are used, for example when carboxylic acids which have been neutralised with aqueous potassium hydroxide solution, are used as corrosion inhibitors. The previously-mentioned further active substances and auxiliary agents may also be optionally present. The second agent contains, as a concentrate, at least 20 wt. % of water and/or further active substances and auxiliary agents. In the simplest case, it contains, in addition to the emulsifier system and the corrosion inhibitors, 20 to 70 wt. % of water and no further active substances and auxiliary agents.

The second agent, in the form of its concentrate and also as its ready-to-use water-diluted formulation, may also contain builders, biocides and/or sequestering agents. Examples of builders are alkali metal orthophosphates, polyphosphates, silicates, borates, carbonates, polyacrylates and gluconates. Some of these builders have complexing properties and thus act as water softeners. Instead of or in addition to these, strong sequestering agents, such as 1-hydroxyethane-1,1-diphosphonic acid or 2-phosphonobutane-1,2,4-tricarboxylic acid, may be used. Ethylenediamine tetraacetate or nitrilotriacetate are also suitable.

The present invention also provides the combination of agents in the ready-to-use form, wherein the cutting compound (the first agent) and the aqueous cleansing/anticorrosion agent (the second agent) are present as water-diluted emulsion, suspension or solution. The ready-to-use form of the first agent is always an oil-in-water emulsion. These ready-to-use aqueous preparations of the first and second agent are obtainable by mixing each of the concentrates of the first and the second agent with water, in a ratio, by weight, from about 0.5 to about 99.5 to about 10 to about 90.

The emulsifier systems used according to the present invention provide the industrial advantage that the ready-to-use Aqueous preparations of the first and second agent tend to produce very little foam even in soft water. To dilute the concentrate to the application concentration, therefore, not only hard water, but also moderately hard water (less than 12° dH) or even soft Cater (less than 8° dH) may be used. Even water having a hardness of less than 4° dH, sometimes even fully deionised water, may be used without foam problems occurring during use of the agent. The combination of agents according to the present invention may also be used in spray processes in the temperature range between the freezing point and the boiling point of the ready-to-use preparations. A minimum temperature for spray applications does not have to be observed, in contrast to conventional neutral cleansers. Obviously, the combination of agents according to the present invention may also be used in hard water without disadvantage.

The second agent, as a cleansing solution, is preferably formulated as a so-called neutral cleanser. The conventional pH of these so-called neutral cleansers is about 6.5 to about 9 in the ready-to-use form.

Another embodiment of the present invention relates to a process for metal cutting procedures using a water-mixed cutting compound, followed by cleansing and/or anticorrosion treatment, characterised in that an oil-in-water emulsion is used as cutting compound which contains:

(i) an emulsifier system consisting of:

(a) ethoxylates/propoxylates of fatty alcohols having 8 to 18 carbon atoms in the alcohol, which contain 2 to 6 ethylene oxide units and 4 to 8 propylene oxide units;

and (b) fatty alcohols and/or fatty alcohol propoxylates having 12 to 24 carbon atoms in the alcohol and 0 to 3 propylene oxide units and/or distillation residues of such fatty alcohols; in the ratio, by weight, a:b= 1:0.2 to 0.2:1;

and (ii) corrosion inhibitors; and that an aqueous solution and/or suspension is used for cleansing and/or corrosion protective treatment which contains the same emulsifier system as the cutting compound.

The details relating to the composition of the agent to be used as cutting compound and the agent which may be used for cleansing and/or anticorrosion treatment are given above.

In the process according to the present invention, an oil-in-water emulsion is preferably used as cutting compound which is obtainable by mixing a concentrate of the first agent in accordance with claim 4, the possible composition being explained in more detail above, with water in the ratio, by weight, from about 0.5 to about 99.5 to about 10 to about 90.

For cleansing and/or anticorrosion treatment, an aqueous solution or suspension which is obtainable by mixing a concentrate of the second agent, as described in more detail in claim 4 and in the previous description, with water in the ratio, by weight, from about 0.5 to about 99.5 to about 10 to about 90. As explained above, moderately hard or even soft water may be used for each of these without foam problems occurring during use of the process according to the present invention.

During use as a cleansing solution, the second agent is used in the ready-to-use water-diluted form in such a way that the temperature is in the range from about 15 to about 80° C. Cleansing may take piece in an immersion unit or in a spray unit. Since spray cleansing is particularly effective, this process if preferably selected. This demonstrates the advantage of the emulsifier combination to be used since, even when using soft water, no foam problems occur over the entire temperature range.

The process according to the present invention also has the advantage that residues of cutting compound, which are incorporated into the cleansing/anticorrosion agent via the item being machined, represent at most contamination of the cleansing/anticorrosion agent with the oil components. Since the emulsifier system in the cutting compound and in the cleansing/anticorrosion agent is identical and the cutting compound contains corrosion inhibitors which are at least compatible with those in the cleansing/anticorrosion agent, or preferably contains corrosion inhibitors which are also present in the cleansing/anticorrosion agent, entrainment of cutting compound does not contaminate the cleansing/anticorrosion agent, but merely adds to its effectiveness. On the one hand, this leads to an extended service time for this agent and, on the other hand, these active substances have to be added less frequently. Thus, the procedure according to the present invention leads to a considerably reduced use of materials and to lower waste disposal costs. The engineering objective of a metal cutting process, followed by cleansing and/or anticorrosion treatment, is thus achieved using smaller amounts of materials and with less pollution of the environment when disposing of the agents which are used when compared with the prior art. In addition, foam problems due to the transfer of materials from the metal processing to the cleansing zone are also avoided.

EXAMPLES

The following Tables contain Examples of concentrates of the first and second agents in the combination of agents according to the present invention. In the anticorrosion test which follows, it is shown that transfer of cutting compound into the cleansing/anticorrosion agent does not impair its anticorrosion effect, rather that it is improved.

TABLE 1

Example 1 of a concentrate of a cutting compound emulsion (first agent), concentration data in wt. %

| | |
|---|---|
| Naphthenic white mineral oil | 30.0 |
| 3,5,5-trimethylhexanoic acid (= isononanoic acid) | 17.5 |
| Caprylic acid | 7.5 |
| C12/C14 fatty alcohol × 3 moles of ethylene oxide and 6 moles of propylene oxide | 8.0 |
| Oleyl/cetyl alcohol × 2 moles of propylene oxide | 8.0 |
| Fatty alcohol distillation residue | 10.6 |
| Monoethanolamine | 7.9 |
| Potassium hydroxide | 4.725 |
| Water | 5.775 |

TABLE 2

Example 2 of a concentrate of a cutting compound emulsion (first agent), concentration data in wt. %

| | |
|---|---|
| Paraffinic mineral oil | 16.6 |
| Rape seed oil | 7.3 |
| 3,5,5-trimethylhexanoic acid (= isononanoic acid) | 9.6 |
| Caprylic acid | 9.6 |
| C12/C14 fatty alcohol × 3 moles of ethylene oxide and 6 moles of propylene oxide | 8.5 |
| Oleyl/cetyl alcohol × 2 moles of propylene oxide | 8.5 |
| Fatty alcohol distillation residue | 16.0 |
| Triethanolamine | 5.2 |
| Potassium hydroxide | 7.425 |
| Octane phosphonic acid | 0.45 |
| Benzotriazole, 1H, 2,3- | 0.2 |
| Pyridinethiol-N-oxide-Na | 0.08 |
| Benzyl hemiacetal | 2.9 |
| Water | 7.645 |

TABLE 3

Example of a concentrate of a cleansing solution (second agent), concentration data in wt. %

| | |
|---|---|
| Process water | 30.0 |
| Isononanoic acid | 17.5 |
| Caprylic acid | 7.5 |
| Oleyl/cetyl alcohol × 2 moles of propylene oxide | 8.0 |
| C12/C14 fatty alcohol × 3 moles of ethylene oxide and 6 moles of propylene oxide | 8.0 |

TABLE 3-continued

| Example of a concentrate of a cleansing solution (second agent), concentration data in wt. % | |
|---|---|
| Fatty alcohol distillation residue | 10.6 |
| Monoethanolamine | 7.9 |
| 45% caustic potash solution | 10.5 |

Ready-to-use cleansing/anticorrosion solutions were prepared from the concentrate of second agent in accordance with Table 3 and anticorrosion test according to DIN 51360/2 was carried out therewith. For this purpose, cast iron turnings were wetted on a round filter paper with the solution and left for 2 hours in a glass dish at room temperature. Then the corrosion stains on the filter paper were assessed visually and classified into degrees of corrosion 0 to 4. Here degree of corrosion 0 means no corrosion, degree of corrosion 1 means traces of corrosion, degree of corrosion 2 means slight corrosion, degree of corrosion 3 means moderate corrosion, degree of corrosion 4 means severe corrosion.

In the case of a 2% mixture of concentrate in process water (pH 9.72), a degree of corrosion 4 was produced, using a 3% strength solution (pH 9.75), a degree of corrosion 0 was produced; and using 4% strength mixture (pH 9.78), a degree of corrosion 0 was also obtained.

Transfer of the cutting compound into the cleansing/anticorrosion solution was simulated by adding 0.2 wt. % of the concentrate in accordance with Table 2 to the previously-described ready-to-use solutions. Then a corrosion test in accordance with DIN 51360/2 was carried out. Results: 2% mixture (pH 9.66): degree of corrosion 2; 3% strength mixture (pH 9.72): degree of corrosion 0;4% strength mixture (pH 9.75): degree of corrosion 0.

Transfer of the cutting compound into the cleansing/anticorrosion solution thus did not impair the degree of corrosion for 3 and 4% strength mixtures of the cleanser concentrate; in the case of a 2% strength mixture, the anticorrosion effect was considerably improved.

We claim:

1. A system for metal cutting and subsequent cleansing and anticorrosion treatment, comprising a first agent and a second agent containing:

(i) an emulsifier comprising:

(a) ethoxylates/propoxylate of fatty alcohols having 8 to 18 carbon atoms in the alcohol which contain 2 to 6 ethylene oxide units and 4 to 8 propylene oxide units;

and (b) at least one member selected from the group consisting of fatty alcohols having 12 to 24 carbon atoms, fatty alcohol propoxylates having 12 to 24 carbon atoms in the alcohol and 0 to 3 propylene oxide units and distillation residues of such fatty alcohols;

in a ratio, by weight, a: b =1:0.2 to 0.2:1;

and (ii) corrosion inhibitors;

wherein the first agent in addition contains an oil component.

2. The system according to claim 1 wherein the first agent and the second agent comprise water-miscible concentrates, the first agent containing:

10 to 40 wt. % of the oil component 10 to 40 wt. % of the emulsifier 20 to 40 wt. % of the corrosion inhibitors;

and the second agent containing:

10 to 40 wt. % of the emulsifier 20 to 40 wt. % of corrosion inhibitors;

and optionally each agent containing a member selected from the group consisting of water, active substances, auxiliary agents and mixtures thereof, the sum of the components being 100 wt. %.

3. The system according to claim 1 wherein the first agent and the second agent are present as water-diluted emulsions, suspensions or solutions which are obtainable by mixing a concentrate of each of the first and second agent with water in a ratio, by weight, of 0.5 to 99.5 to 10 to 90.

4. The system according to claim 1 wherein the oil component in the first agent comprises at least one member selected from the group consisting of paraffinic mineral oils, naphthenic mineral oils, dialkylethers having 12 to 20 carbon atoms and ester oils.

5. The system according to claim 4 wherein the corrosion inhibitor comprises at least one member selected from the group consisting of alkanolamines, branched or unbranched, saturated or unsaturated aliphatic mono- or di-carboxylic acids having 6 to 10 carbon atoms anal aromatic carboxylic acids having 7 to 10 carbon atoms, wherein the carboxylic acids are at least partially present as salts.

6. The system according to claim 4 wherein the first agent and the second agent comprise water-miscible concentrates, the first agent containing:

10 to 40 wt. % of the oil component.

10 to 40 wt. % of the emulsifier;

20 to 40 wt. % of the corrosion inhibitors;

and the second agent containing:

10 to 40 wt. % of the emulsifier;

20 to 40 wt. % of corrosion inhibitory;

and optionally each agent containing a member selected from the group consisting of water, active substances, auxiliary agents and mixtures thereof, the sum of the components being 100 wt. %.

7. The system according to claim 4 wherein the first agent and the second agent are present as water-diluted emulsions, suspensions or solutions which are obtainable by mixing the concentrates of each of the first and second agent with water in a ratio, by weight, of 0.5 to 99.5 to 10 to 90.

8. The system according to claim 1 wherein the corrosion inhibitor comprises at least one member selected from the group consisting of alkanolamines, branched or unbranched, saturated or unsaturated aliphatic mono- or di-carboxylic acids having 6 to 10 carbon atoms and aromatic carboxylic acids having 7 to 10 carbon atoms, wherein the carboxylic acids are at least partially present as salts.

9. The system according to claim 8 wherein the first agent and the second agent comprise water-miscible concentrates, the first agent containing:

10 to 40 wt. % of the oil component;

10 to 40 wt. % of the emulsifier;

20 to 40 wt. % of the corrosion inhibitors;

and the second agent containing:

10 to 40 wt. % of the emulsifier;

20 to 40 wt. % of corrosion inhibitors;

and optionally each agent containing a member selected from the group consisting of water, active substances, auxiliary agents and mixtures thereof, the sum of the components being 100 wt. %.

10. The system according to claim 8 wherein the first agent and the second agent are present as water-diluted emulsions, suspensions or solutions which are obtainable by mixing the concentrates of each of the first, and second agent with water in a ratio, by weight, of 0.5 to 99.5 to 10 to 90.

11. A process for metal cutting using a water-mixed cutting compound and subsequent cleansing and anticorrosion treatment, wherein, an oil-in-water emulsion is used as a cutting compound which contains:

(i) an emulsifier system comprising:

(a) ethoxylates/propoxylates of fatty alcohols having 8 to 18 carbon atoms in the alcohol which contains 2 to 6 ethylene oxide units and 4 to 8 propylene oxide units;

and (b) at least one member selected from the group consisting of fatty alcohols having 12 to 24 carbon atom fatty alcohol propoxylates having 12 to 24 carbon atoms in the alcohol and 0 to 3 propylene oxide units and distillation residues of such fatty alcohols; in a ratio, by weight, a:b =1:0.2 to 0.2:1;

(ii) corrosion inhibitors; and (iii) an oil component; and an aqueous solution and/or suspension is used for cleansing and anticorrosion treatment which contains the same emulsifier system and the same corrosion inhibitors as the cutting compound.

12. The process according to claim 11 wherein the oil-in-water emulsion used as the cutting compound is obtained by mixing a concentrate of the first agent with water in a ratio, by weight, 0.5 to 99.5 to 10 to 90.

13. The process according to claim 11 wherein an aqueous solution or suspension is used for cleansing and anticorrosion treatment which is obtained by mixing a concentrate of the second agent with water in a ratio, by weight, 0.5 to 99.5 to 10 to 90.

* * * * *

UNITED STATES PATENT AND TRADEMARK OFFICE

CERTIFICATE OF CORRECTION

PATENT NO. : 6,524,396 B1 
DATED : February 25, 2003
INVENTOR(S) : Geke et al.

It is certified that error appears in the above-identified patent and that said Letters Patent is hereby corrected as shown below:

Title page,
Item [73], Assignee, delete "aut", and insert therefor -- auf --; and delete "Gulph Mills, PA (US)" and insert therefor -- Duesseldorf (DE) --.

Item [57], ABSTRACT,
Line 5, delete "(I)", and insert therefor -- (i) --.
Line 10, delete "alcohols", and insert therefor -- alcohol --.
Line 14, delete "In", and insert therefor -- in --.
Line 16, delete "inhibitory", and insert therefor -- inhibitors --.
Line 17, delete "an", and insert therefor -- and --.
Line 21, delete "systems", and insert therefor -- system --.

Column 7,
Line 46, delete "ethoxylates/propxylate", and insert therefor -- ethoxylates/ propoxylates --.
Line 66, after "component", insert -- ; --.
Line 67, after "emulsifier", insert -- ; --.

Column 8,
Line 3, after "emulsifier", insert -- , --.
Line 23, delete "anal", and insert therefor -- and --.
Line 29, after "component", delete ".", and insert therefor -- ; --.
Line 35, delete "inhibitory", and insert therefor -- inhibitors --.

Column 9,
Line 15, delete "atom", and insert therefor -- atoms --.

Signed and Sealed this

Twenty-ninth Day of July, 2003

JAMES E. ROGAN
*Director of the United States Patent and Trademark Office*